United States Patent [19]

Bessone et al.

[11] 4,010,399

[45] Mar. 1, 1977

[54] SWITCHING CIRCUIT FOR A FLUORESCENT LAMP WITH HEATED FILAMENTS

[75] Inventors: Carlo S. Bessone, Cambridge; Frank M. Latassa, Magnolia, both of Mass.

[73] Assignee: GTE Sylvania Incorporated, Danvers, Mass.

[22] Filed: Dec. 22, 1975

[21] Appl. No.: 643,098

[52] U.S. Cl. ..... 315/101; 315/73; 315/97; 315/98; 315/106; 315/119

[51] Int. Cl.[2] ..... H05B 41/23

[58] Field of Search ..... 315/94, 97, 98, 99, 315/101, 106, 107, 119, 123, 208, 73; 328/270

[56] References Cited

UNITED STATES PATENTS

| | | | |
|---|---|---|---|
| 2,317,602 | 4/1943 | Hall, Jr. et al. | 315/106 X |
| 2,330,312 | 9/1943 | Raney, Jr. | 315/106 X |
| 3,668,259 | 2/1954 | Stutsman | 315/101 X |

*Primary Examiner*—Eugene R. La Roche
*Attorney, Agent, or Firm*—James H. Grover

[57] ABSTRACT

A ballast for a rapid start fluorescent lamp with heated filaments has a secondary winding supplying lamp current, tertiary windings for supplying heater current to the filaments, and solid state switching circuits in secondary circuits through the filaments. Each switching circuit, which may be integrated with the ballast circuit or connected to a filament within the lamp envelope, comprises two voltage divider resistors having a common junction coupled to the gate of a triac whose primary electrodes are connected in parallel with the voltage divider. The triac is in series with the filament and supplies heating current to the filaments prior to lamp starting. When the lamp starts and conducts rated operating current the voltage divider reduces the voltage at its junction and at the triac gate below triac breakdown level thereby substantially eliminating heater current.

3 Claims, 2 Drawing Figures

SWITCHING CIRCUIT FOR A FLUORESCENT LAMP WITH HEATED FILAMENTS

BACKGROUND OF THE INVENTION

Commonly used fluorescent lamp ballast are of the rapid start type which includes a transformer primary winding and a secondary winding supplying operating current to the lamp, and also one or more heater windings which supply current through the filaments at each end of the fluorescent lamp. The heating current is supplied when power is switched on to the ballast and resistively heats the filaments to emissive state. In this state a relatively low voltage, and hence a smaller and less expensive ballast, is needed to ignite an arc across the lamp. Heating the filaments protects them from damage which would occur with cold ignition, and prolongs lamp life.

The rapid start ballast circuit has the disadvantage that heater current continues to flow when not needed after the lamp starts, and accordingly it is an object of the invention to eliminate the waste of continuous heater current while retaining the advantages of rapid starting.

STATEMENT OF INVENTION

According to the invention an electronic circuit for a fluorescent lamp with heated filaments comprises primary lamp terminals for carrying lamp current, secondary lamp terminals for supplying heating current to the lamp filaments, a transformer including a primary winding for alternating line current, a secondary winding with connections to the primary lamp terminals, and a tertiary winding in a secondary circuit through the secondary lamp terminals, switching means in the secondary circuit including a voltage divider with a junction intermediate the divider, an electronic valve connected in parallel with the voltage divider, the valve having a control coupled to the junction for causing conduction on each half cycle of aternating applied conduction on each half cycle of alternating applied to the control, and the voltage divider and valve respectively being in series with the lamp terminals such that rated lamp current through the voltage divider applies a voltage at the control lower than the breakdown voltage of the valve, thereby to stop conduction of the valve and limit current through the lamp filaments.

DRAWING

Figure 1:
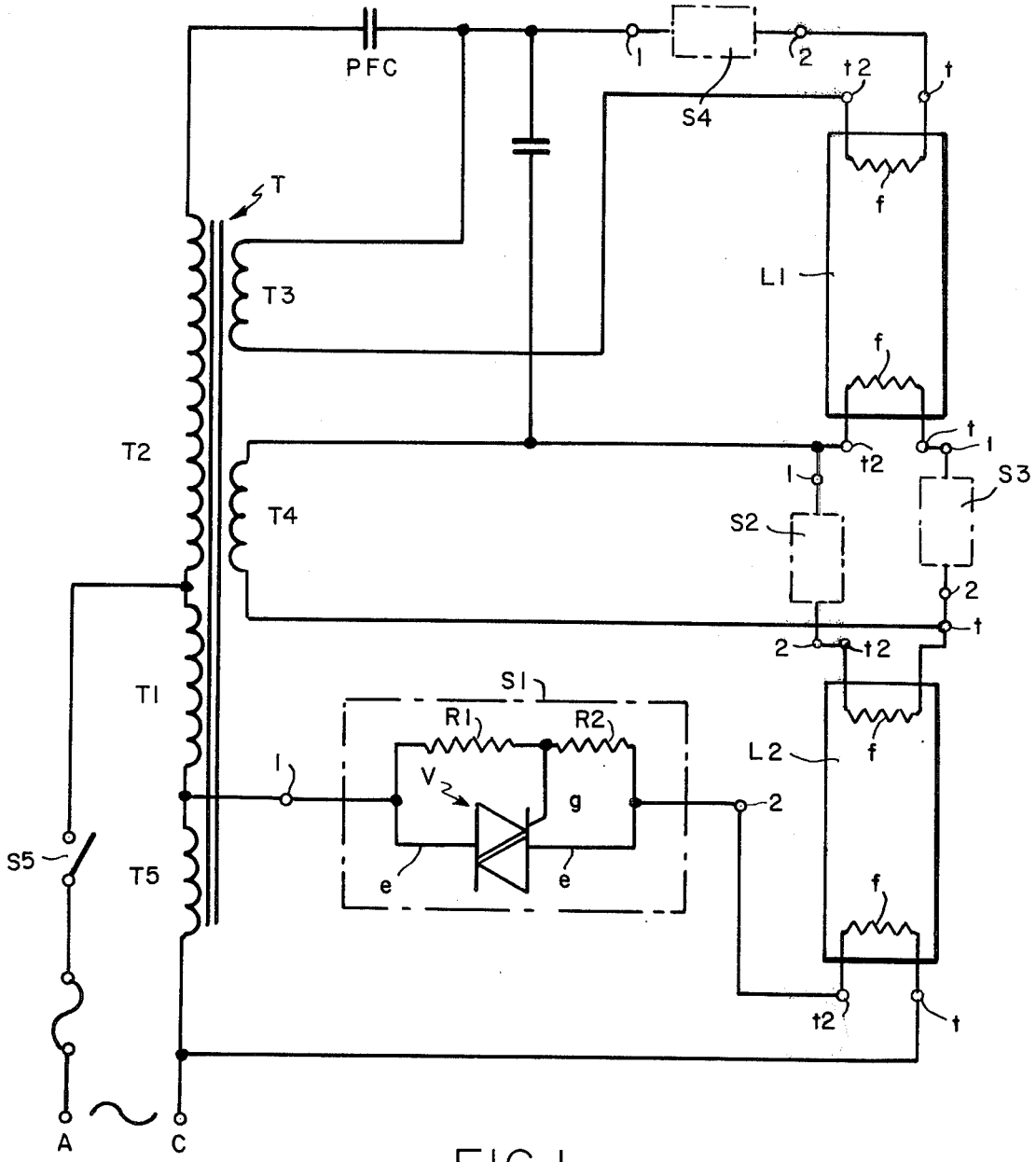
Figure 2:
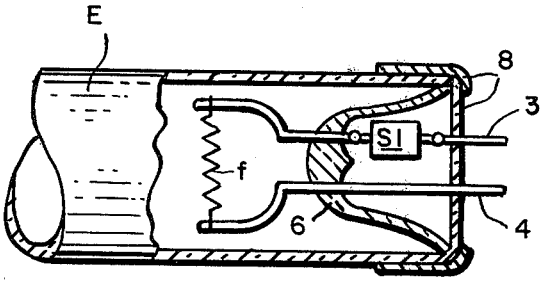

FIG. 1 is a schematic diagram of a rapid start ballast circuit with switching means according to the invention; and FIG. 2 is an elevation, partly broken away, of a fluorescent lamp with internal switching means.

DESCRIPTION

The rapid start ballast circuit of FIG. 1 comprises a transformer T having a primary winding T1 connected through an on-off switch S5 to alternating current line terminals A and C. A secondary winding T2 has connections through a power factor correcting capacitor PFC to one primary terminal *t* for two fluorescent lamps L1 and L2 also through the primary winding to another primary lamp terminal *t*. The lamp terminals *t* supply operating current for the lamps after they have started arc discharge, and also act as secondary lamp terminals. Tertiary windings T3, T4 and T5 supply low voltage heating current to secondary terminals *t*2 for filaments *f* in pairs at the ends of the two lamps L1 and L2, the filaments being emissively coated to support arc discharge between filaments.

The rapid start ballast circuit as so far described, omitting switches S1, S2, S3 and S4, is of conventional design and operation. Closing the on-off switch S5 supplies line current to the transformer primary T1 and induces current in the secondary T2 and tertiary windings T3, T4, T5. The tertiary winding current rapdily, e.g. in 2 seconds, heats the filaments to emissive state whereupon an arc may strike between each pair of filaments. Once the arc is ignited the heating current in conventional rapid start ballast circuits is not required but continues to flow.

On the average approximately 5% of the total lamp and ballast wattage consumption is wasted in such a prior circuit for two 40 watt rapid start lamps. It may be possible to open the filament heating circuits by thermally or otherwise sensing the heating current, but such a system would not assure that the lamps have properly started and will continue burning.

According to the present invention, solid state switching networks S1, S2, S3 and S4 are connected in a secondary circuit through each pair of secondary lamp terminals *t*2. Each of the four secondary circuits consists of one filament *f* and its secondary terminals *t*2, a tertiary winding T3, T4 or T5 and a switching network, all in series.

Each of the switching networks S1 – S4 consists of a voltage divider R1 (870 ohms) and R2 (190 ohms), and a solid state, bidirectional switch or valve V known as a triac (Motorola, Inc., type MAC-77-4) connected in parallel between two network terminals 1 and 2, also individually in series with the lamp terminals. The common junction J between the divider resistors R1 and R2 is coupled to the gate *g* of the triac. As explained further, prior to striking of an arc across the series connected lamps L1 and L2 the triac is held open, conducting current between its primary electrodes *e* to a lamp filament *f*.

Care should be taken that each network S1 – S4 is connected to the low current lamp terminals and ballast transformer windings as shown in FIG. 1. With respect to the filaments supplied by tertiary winding T4 it may be explained that winding nominally supplies 300 milliameres to the two interconnected filaments *f* of lamps L1 and L2, and the secondary winding T2 supplies a nominal 400 milliamperes additional lamp current respectively through networks S2 and S3. When the lamps are ignited and drawing rated lamp current, as compared to filament current, the net 700 ma. current at terminal *t* between lamps L1 and L2 divides 500 ma. to lamp L1 and 200 ma. to lamp L2. Thus, as to lamp L2 and switching network S2, terminal *t*2 is the low current terminal. As to lamp L1 the net nominal 700 ma. current divides 200 ma. to lamp L1 so that as to lamp L1 and switching network S3 again the terminal *t*2 is the low current terminal.

Connected properly as described above, the respective filament current networks S1 – S4 operate as follows. When the on-off switch S5 is closed approximately 300 ma. current flows through each coated filament *f* heating the filament rapidly (e.g. in 2 seconds) to emissive state. During this heating phase the voltage divider R1 and R2 conducts only filament heating current and holds the triac conductive. Then the lamps L1 and L2 strike arcs between their filaments and conduct the nominal 400 ma. rated lamp current.

Once the lamp conducts rated operating current the current through the voltage divider R1 – R2 is reduced because of an out of phase relationship between filament heating current and lamp current, and the divider junction voltage produces a voltage at the triac valve control *g* lower than the breakdown voltage of the triac. The triac then ceases conducting heating current to its filament. Although a very small current (e.g. 12 milliamperes) flows through the voltage divider resistors R1 and R2, this current is negligible compared to the previous 300 milliampere heating current and substantially all of the 5% energy saving is realized in the circuit shown in FIG. 1 with two 40 watt rapid start lamps. In an art where a 2% to 3% energy saving is considered important, a 5% saving is quite significant.

As shown in FIG. 2 the same significant energy saving may be realized without alternation or replacement of the ballasts in the millions of existing fluorescent lamp fixtures now installed. One of the same switching circuits S1 described with respect to FIG. 1 is disposed within the lamp envelope E in one of the leads or pins 3 or 4 which extends to the filament *f* through the stem press 6 sealing each end of the lamp. The circuit S1 in FIG. 2 comprises the same voltage divider and triac as in FIG. 1, and is encapsulated and located outside the stem press 6 and inside each base 8 of the lamp. Such a lamp can be installed in any existing rapid start fluorescent lamp fixture with the leads oriented so that each voltage divider-triac switching network S1 is connected to the low current lamp terminal as previously explained.

It should be understood that the present disclosure is for the purpose of illustration only and that this invention includes all modifications and equivalents which fall within the scope of the appended claims.

We claim:

1. An alternating current rapid start fluorescent lamp ballast circuit comprising:

a rapid start fluorescent lamp including an envelope, emissive filaments spaced apart within the envelope and two leads into the envelope to each filament, the leads comprising primary and secondary lamp terminals for supplying rated arc discharge current between filaments and current through each filament to heat the filament to arc supporting emissive state, a transformer including a primary winding for alternating line current, a secondary winding connected to the primary lamp terminals, and a tertiary winding in a secondary, heating circuit through secondary lamp terminals and a filament; and switching means in the secondary circuit including a voltage divider with a junction intermediate the divider, and an electronic valve connected in parallel with the divider, the valve having a control coupled to the junction for causing conduction on each half cycle of alternating current applied across the valve when a break down voltage is applied from the junction to the control, The voltage divider and valve respectively being in series with the lamp terminals and filament such that rated operating current through the lamp produces a voltage at the control lower than the breakdown voltage of the valve, thereby to stop conduction of the valve and limit current through the lamp filaments after the lamp conducts rated operating current.

2. An alternating electronic circuit for a fluorescent lamp with heated filaments comprising:

primary lamp terminals for carrying lamp current, secondary lamp terminals for supplying heating current to the lamp filaments, a transformer including a primary winding for alternating line current, a secondary winding with connections to the primary lamp terminals, and a tertiary winding in a secondary circuit through the secondary lamp terminals, switching means in the secondary circuit including a voltage divider with a junction intermediate the divider, and an electronic valve connected in parallel with the voltage divider, the valve having a control coupled to the junction for causing conduction on each half cycle of alternating applied across the valve when a break down voltage is applied to the control, and the voltage divider and valve respectively being in series with the lamp terminals such that rated operating current through the lamp applies a voltage at the control lower than the breakdown voltage of the valve, thereby to stop conduction of the valve and limit current through the lamp filaments.

3. An alternating current fluorescent lamp comprising:

an envelope, emissive filaments spaced apart within the envelope, two leads into the envelope to each filament for supplying rated lamp arc discharge current between filaments and current through each filament to heat the filament to arc supporting emission state, one lead for each filament including a switching circuit within the envelope, each switching circuit including;

a voltage divider with a junction intermediate the divider, and an electronic valve connected in parallel with the divider, the valve having a control coupled to the junction for causing conduction of filament heating current through the valve when a breakdown voltage is applied from the junction to the control, the divider and valve respectively being connected in series with the lamp filament so that conduction of rated operating lamp current between filaments reduces the divider junction voltage below breakdown, therby to stop conduction of the valve and substantially eliminate heating current through the filament.

* * * * *